United States Patent [19]

Benedict et al.

[11] Patent Number: 4,879,894

[45] Date of Patent: Nov. 14, 1989

[54] PRESS WITH MOVABLE WORKPIECE SUPPORT CARRIER

[75] Inventors: Roger J. Benedict; John K. Forlow, both of Rockford, Ill.

[73] Assignee: Roper Whitney Company, Rockford, Ill.

[21] Appl. No.: 202,934

[22] Filed: Jun. 6, 1988

[51] Int. Cl.[4] ..... B21J 13/08; B21J 13/16; B21D 28/26

[52] U.S. Cl. ..... 72/405; 72/420; 72/421; 72/427; 72/328; 72/333; 83/412

[58] Field of Search ..... 72/417, 420, 421, 427, 72/361, 328, 327, 333, 405; 83/132, 142, 143, 378, 385, 386, 684, 412, 414

[56] References Cited

U.S. PATENT DOCUMENTS

| | | | |
|---|---|---|---|
| 3,003,447 | 10/1961 | Gavazzi | 72/328 |
| 3,368,383 | 2/1968 | Marszal | 72/361 |
| 3,488,987 | 1/1970 | Stoeckli | 72/327 |
| 3,832,881 | 9/1974 | Henzler et al. | 72/420 |
| 4,033,168 | 7/1977 | Fisk | 72/420 |
| 4,669,346 | 6/1987 | Benedict . | |

*Primary Examiner*—Daniel C. Crane

*Attorney, Agent, or Firm*—Vernon J. Pillote

[57] ABSTRACT

A press having a work positioning carriage for moving a workpiece horizontally along relatively transverse X and Y axes to position different areas of a workpiece at a work station. Lower forming tools are fixed at the work station and a lower stripper is mounted for vertical movement relative to the lower forming tools. Upper press tools are mounted on the press ram and operative when the ram is moved downwardly to force the workpiece downwardly over the lower forming tools and depress the lower stripper. The lower stripper is yieldably biased upwardly to raise the workpiece off the lower press tools when the upper press tools are raised. A work carrier is mounted for horizontal movement by the work positioning carriage and the work carrier has a workpiece support that is vertically movable relative to the work carrier. A master hydraulic actuator is operated during movement of the ram and is hydraulically connected to a slave fluid actuator mounted on the work carrier and connected to the workpiece support to raise and lower the workpiece support relative to the carrier in timed relation with movement of the ram.

26 Claims, 8 Drawing Sheets

44
46
56
48b
24
35
34
152
4
152a
152c
171
2
133
116
91
129
112
107
55
106
111
33
102
3
39a
70
101
125
155
32
31
122
131
128
160
91
64
38
102
W
121
5
126
135
127
125
48a
56
59
46
44
104
108
113
133
92
117
159
114
109
5
2
33
39b
41
58
62

Fig. 4.
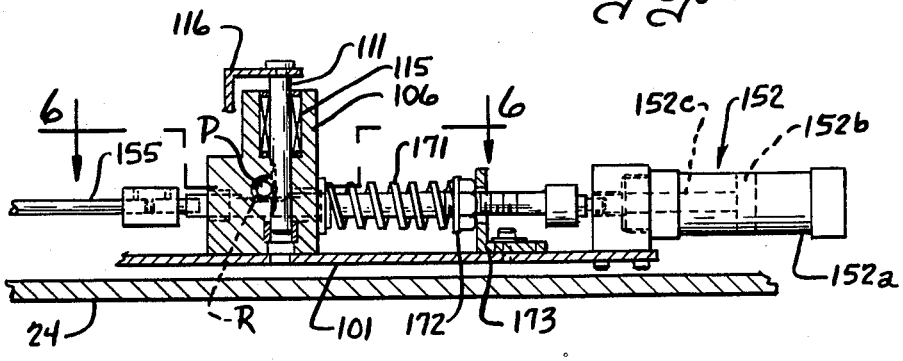
Fig. 5.
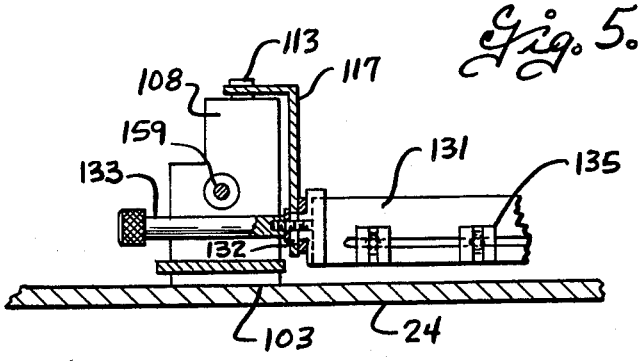
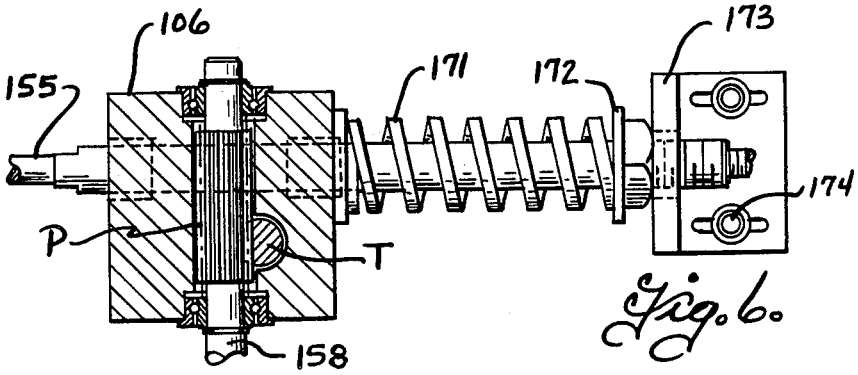
Fig. 6.

Fig. 14
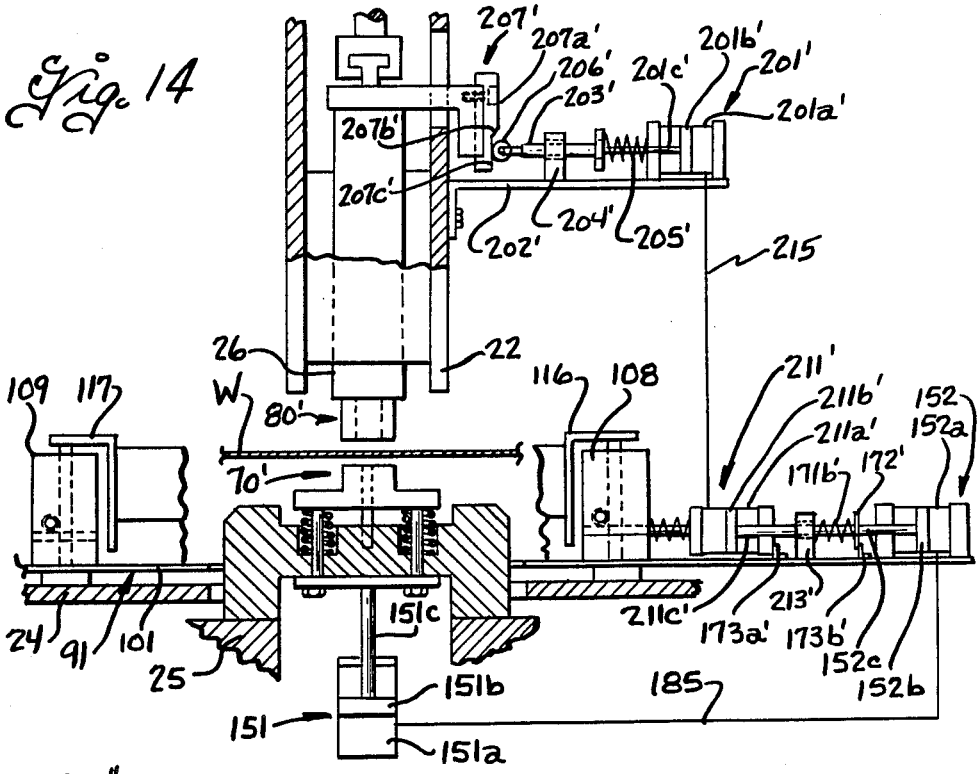
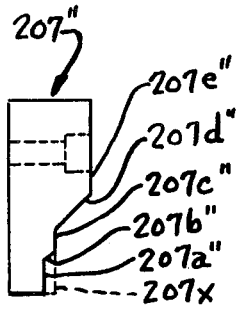
Fig. 16.
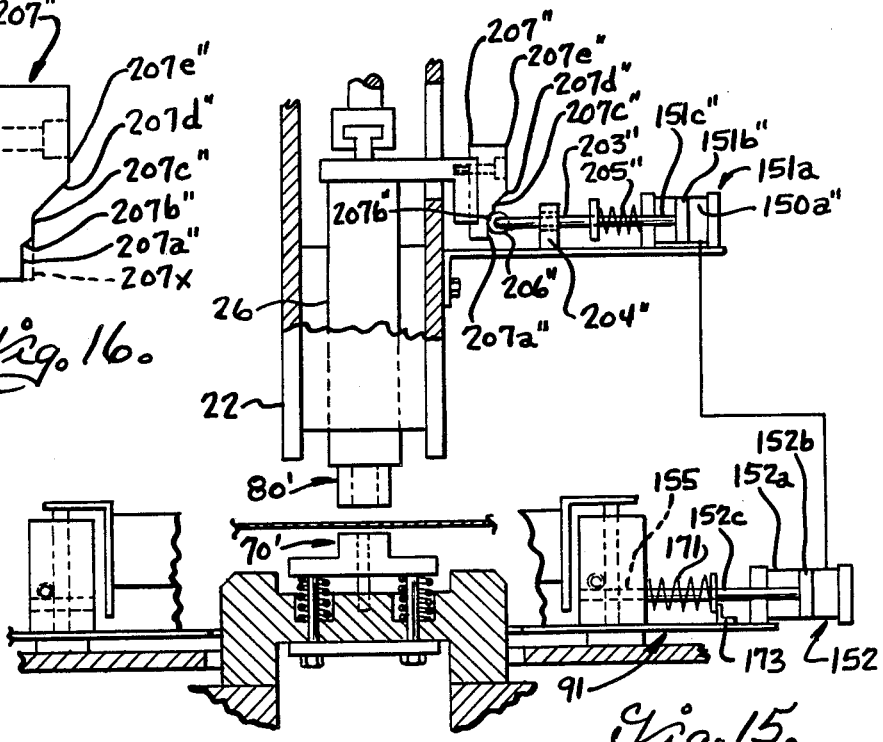
Fig. 15.

PRESS WITH MOVABLE WORKPIECE SUPPORT CARRIER

BACKGROUND OF THE INVENTION

Presses have heretofore been made, for example as disclosed in the applicant's prior U.S. Pat. No. 4,669,346, with horizontally movable stock positioning apparatus that can be operated either manually or by numerically controlled mechanism, to move a sheet stock workpiece horizontally along first and second relatively transverse axes in the plane of the workpiece, to position different areas of the workpiece at a press work station. Presses with such horizontally movable carriages are adapted for use in performing piercing or blanking operations on the sheet stock workpiece. However, problems are encountered when it is desired to perform a forming operation on the workpiece in which different areas of the workpiece are drawn, embossed or otherwise deformed laterally out of the plane of the workpiece. Conventional presses have a vertically movable ram disposed above the work station. If the upper and lower press tools are arranged to perform a forming operation in which the workpiece is deformed downwardly from the plane of the workpiece, then the downwardly deformed portions on the workpiece can interfere with horizontal movement of the deformed areas of the workpiece past the lower press tools. The press can also be arranged so that the upper press tool presses the workpiece downwardly over the lower press tool to deform an area of the workpiece upwardly. In the prior presses with horizontally movable work positioning carriers known to the applicant, the carrier gripped and supported a large sheet adjacent its periphery at a fixed level and the sheet had to flex in areas inwardly of its gripped periphery in order to accommodate vertical movement of the area of the sheet engaged by the upper and lower press forming tools during a forming operation. In such machines the sheet could be laterally deformed only in areas spaced a substantial distance from the stock grippers. Moreover, flexing of the sheet limited the accuracy with which the forming operation could be performed.

SUMMARY OF THE INVENTION

It is an object of the present invention to overcome the problems in prior art presses with horizontally movable stock positioning apparatus, by providing a press with a horizontally movable stock positioning carrier having workpiece support means that supports a workpiece for vertical movement relative to the carrier during a forming operation.

Another object of this invention is to provide a press having a horizontally movable stock positioning carrier for positioning different areas of a workpiece at a work station and which can accommodate either upward deforming, downward deforming or both upward and downward deforming of successive areas of the workpiece by the press tools at the forming station.

Still another object of this invention is to provide a press having a horizontally movable stock positioning carrier and a workpiece support means movable vertically relative to the carrier, in which vertical movement of the workpiece support means relative to the stock positioning carrier is substantially synchronized with vertical movement of area of the workpiece engaged by the press tools during a forming operation.

Accordingly, the present invention provides a press for performing successive forming operations on different areas of a workpiece, the press including a stationary frame means having a work station, lower press tool means mounted on the stationary frame means below the work station, ram means mounted on the frame means above the work station and operable through a cycle having a downward forming stroke and upward return stroke, and upper press tool means mounted on the ram means. A work positioning carrier means is mounted for movement in a generally horizontal plane relative to the stationary frame means, and workpiece support means are mounted on the carrier means for movement horizontally therewith and for limited vertical movement relative thereto. Means are provided for moving the carrier means in a generally horizontal plane to position different areas of the workpiece at the work station and the upper press tool means is operative in the downward stroke of the ram means to force the workpiece downwardly on the lower press tool means. Means are provided for moving the workpiece support means downwardly relative to the carrier means as the ram means forces the workpiece downwardly onto the lower punch means and for moving the workpiece support means upwardly relative to the carrier means during movement of the ram means in the upward return stroke.

The operating means for moving the workpiece support means relative to the carrier means advantageously includes a master hydraulic actuator means actuated during movement of the ram means, and a slave hydraulic actuator mounted on the carrier means and operatively connected to the workpiece support means for moving the latter vertically relative to the carrier means.

BRIEF EXPLANATION OF THE DRAWINGS

FIG. 4 is a fragmentary sectional view taken on the plane 4—4 of FIG. 1 and illustrating parts on a larger scale than FIG. 1;

FIG. 5 is a fragmentary vertical sectional view taken on the plane 5—5 of FIG. 1 and illustrating parts on a larger scale than FIG. 1;

FIG. 6 is a fragmentary vertical sectional view taken on the plane 6—6 of FIG. 4;

FIG. 14 is a schematic diagram of a modified hydraulic circuit for vertically moving the work support means relative to the work positioning carrier;

FIG. 15 is a schematic diagram of another modified hydraulic circuit for vertically moving the work support means relative to the work positioning carrier; and FIG. 16 is a side view of a modified form of cam for use in the embodiment of FIG. 15.

DETAILED DESCRIPTION OF A PREFERRED EMBODIMENT

Figure 1:
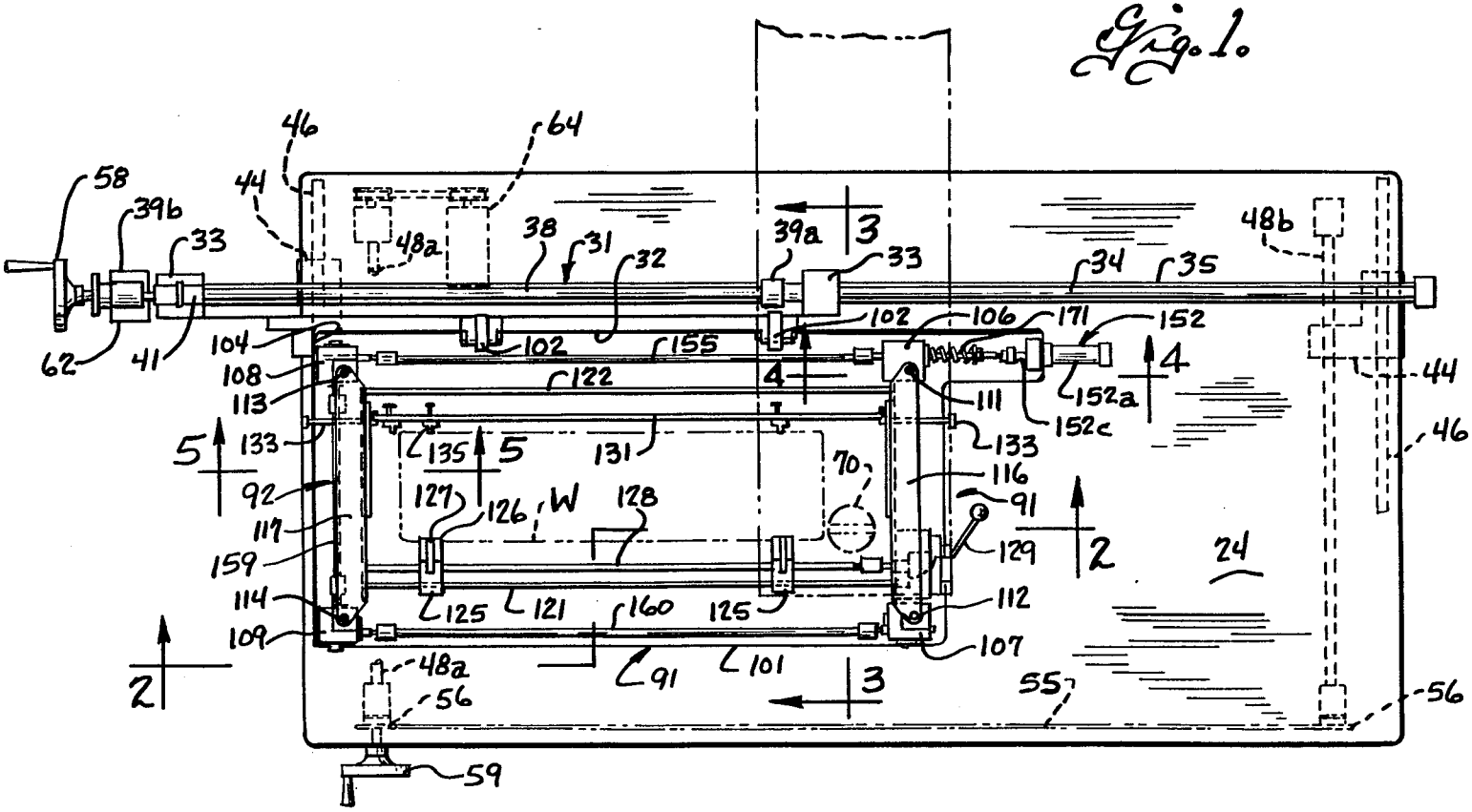
FIG. 1 is a plan view of a press having the work positioning means of the present invention mounted thereon.

The present invention relates to presses having a horizontally movable work positioning apparatus for moving a workpiece horizontally along a relatively transverse X and Y axes relative to the press work station, and more particularly to a press having a horizontally movable work positioning carrier and a workpiece support apparatus that is movable horizontally with the work positioning carrier and which is operative to move the workpiece vertically relative to the carrier along a Z-axis perpendicular to the X and Y axes during a forming operation.

The press has a stationary frame structure including a base 21, upright press frame members 22 of generally C-shaped configuration as viewed from the side (see FIG. 3) and which define a throat or work opening 23, and a horizontal work table 24 that extends into the throat or work opening and is fixedly attached to the press frame members 22 at the underside of the throat. A bolster 25 is fixed to the press frame members below the throat and a ram 26 is mounted on the press frame members above the throat for movement toward and away from the bolster by any conventional means, such as an hydraulic piston and cylinder assembly 27 (see FIG. 2). As used herein, the phrase stationary frame means refers to the stationary parts of the press including but not limited to the base 21, press frame members 22, work table 24 and bolster 25.

Work positioning carriage means 31 are provided for moving a workpiece horizontally along first and second relatively transverse paths in the plane of the workpiece to position different areas of the workpiece at a punch press work station between the bolster 25 and ram 26. The work positioning carriage means is conveniently of the type disclosed in the applicant's prior U.S. Pat. No. 4,669,346, the disclosure of which is incorporated herein by reference. The work positioning carriage means includes an elongated support rail 32 that is mounted by guides 33 on linear ways 34 fixed to a carriage bar 35. The carriage bar 35 extends across the top of the work table 24 parallel to one axis of the work table, hereinafter sometimes referred to as the X-axis, and the guides 33 support the rail 32 for movement along a first path lengthwise of the rail and parallel to the plane of the table 24. A lead screw 38 is supported by brackets **39*a*, 39*b* on the carriage bar 35 to extend lengthwise thereof and a lead screw follower 41 is mounted on the lead screw 38 and is connected to the rail 32 to move the rail along the carriage bar 35** in a direction and distance corresponding to the direction and angular rotation of the screw.

The carriage bar 35 extends parallel to X-axis across the top of the work table 22 and is guided for movement in a transverse direction along a Y-axis across the work table by brackets 44 fixed to the carriage bar adjacent opposite ends and which have followers that slidably engage linear ways 46 at the underside of the work table. A means such as a pair of lead screws **48*a*, 48*b* are mounted at the underside of the work table for rotation about axes parallel to the linear ways 46, and screw followers on the brackets 44 engage the lead screws to move the carriage bar 35 forwardly and rearwardly over the top of the work table 24. As shown in FIG. 1, the lead screws 48*a* and 48*b* are drivingly interconnected for rotation in unison as by a chain 55 entrained over sprockets 56 on the screws 48*a* and 48*b*. The lead screws can be operated manually or power operated as by computer numerical control apparatus to effect positioning of the workpiece along respective X and Y axes. In the embodiment illustrated, lead screw 38 is arranged to be manually operated by a crank wheel 58 and lead screw 48*a* is arranged to be manually operated by a crank wheel 59. The work positioning carriage means 31 can also be automatically operated by a conventional computer numerical control apparatus to effect automatic positioning of the workpiece at preselected locations relative to the work station and operation of the press in timed relation with the carriage positioning means. As shown in FIG. 1, a motor drive 62 is provided for driving the lead screw 38 and a motor drive 64 is provided for driving the lead screw 48*a*. Shaft encoders (not shown) are operatively connected to the lead screws 38 and 48*a* and arranged to produce a number of electrical output pulses per revolution of the respective shaft, and which may be utilized to provide a visual display of the position of the rail 32** along the X and Y axes and which may also be utilized by conventional computer numerical control apparatus to effect automatic control of the motor drives for the work positioning lead screws.

The punch press is adapted to perform forming operations on a workpiece W of a nature such that the workpiece is laterally formed or deformed from the plane of the workpiece during the punching operation. The forming operation may involve drawing or embossing different areas of the workpiece, either alone or combined with piercing or punching of the workpiece, and which produces laterally deformed areas in the workpiece. In the embodiment illustrated, upper and lower press tool assemblies are arranged to form a radiator header in which the header is laterally deformed during piercing of the openings in the header to form flanged openings for receiving the tubes of a heat exchanger.

Figure 7:
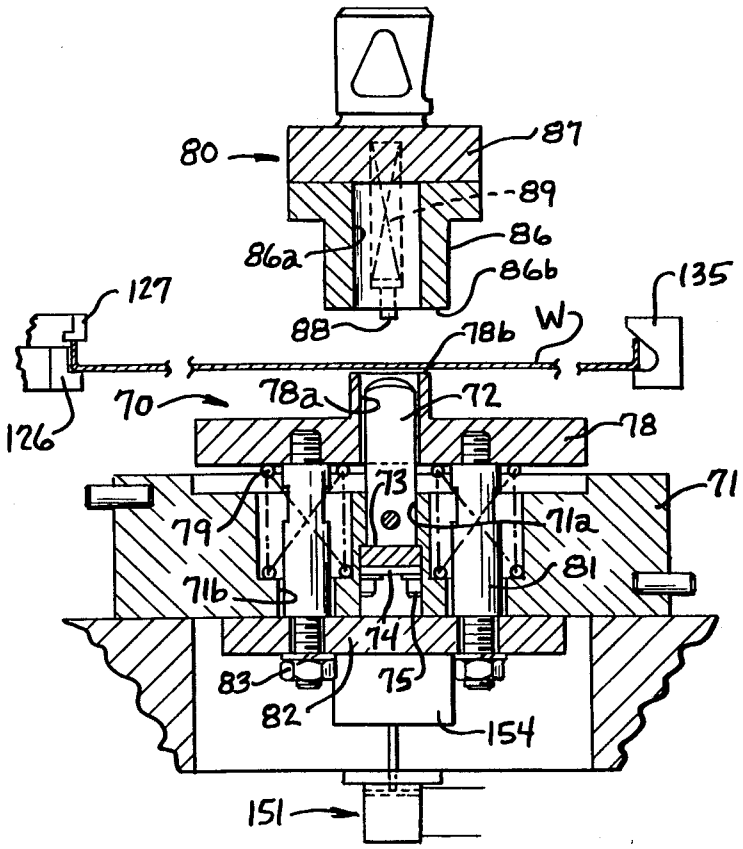
FIG. 7 is a fragmentary vertical sectional view through the upper and lower press tool assemblies taken on the plane 3—3 of FIG. 1 and illustrating parts on a larger scale than FIG. 3 and showing the ram in a raised position.

In the embodiment of FIGS. 1–11, the upper press tool assembly 80 and lower press tool assembly 70 are arranged to draw or deform the workpiece upwardly from the plane of the workpiece. As best shown in FIGS. 2, 3, 7 and 8, the lower press tool assembly 70 includes a lower press tool holder 71 fixedly mounted on the bolster 25 and lower forming tool means herein shown as forming and piercing punches 72, fixed to the lower press tool holder to extend upwardly therefrom. The lower ends of the punches 72 are conveniently disposed in vertical slots **71*a* in the lower press tool holder and are supported at their lower ends by a backing plate 73 that underlies the lower ends of the punches and which is retained in position on the punch holder by retainer plates 74 and fasteners 75. Retaining pins 76 extend through openings in the punch holder and punches to retain the punches against upward movement. The lower press tool assembly also includes a lower stripper 78 that overlies the lower press tool holder 71 and has openings 78***a* therethrough for guidably receiving the punches 72. The lower stripper is supported for limited vertical movement relative to the punches and lower press tool holder and, as best shown in FIG. 7, guide pins 81 are fixed at their upper ends to the stripper and guidably extend through passages 71*b* in the lower press tool holder, and an actuating plate 82 is attached to the lower ends of the guide pins 81 as by nuts 83, for vertical movement with the punches 72. The stripper has an upper work engaging surface 78*b* and the stripper is yieldably urged by springs 79 to a raised position in which the work engaging surface 78*b* is at or above the upper ends of the punches 72 to strip a workpiece off the punches. The actuating plate 82 is arranged to engage the underside of the lower punch holder to limit upward movement of the stripper to a position in which the work engaging surface is at or above the upper ends of the punches.

Figure 8:
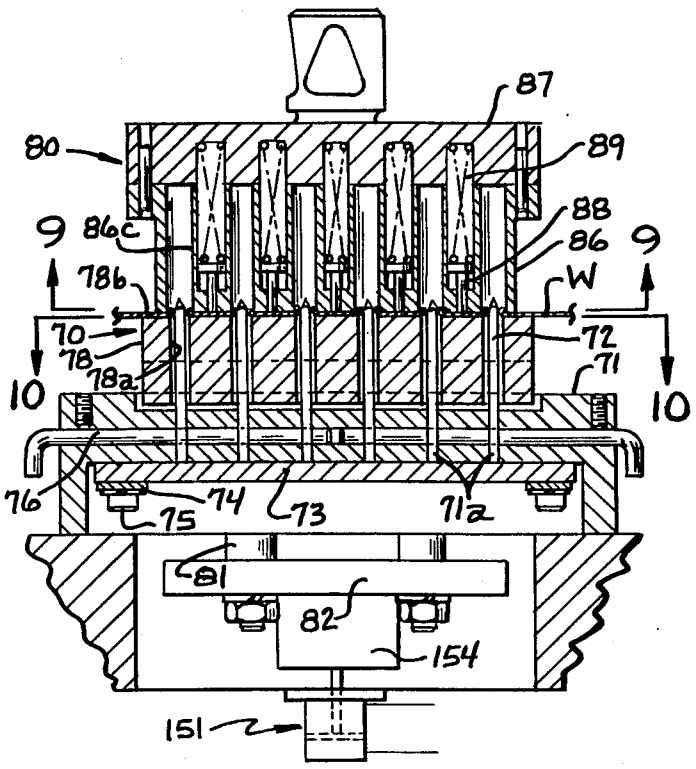
FIG. 8 is a fragmentary vertical sectional view through the upper and lower press tool assemblies taken on a plane at right angles to the plane of FIG. 7, and illustrating the ram in a lowered position.
Figure 9:
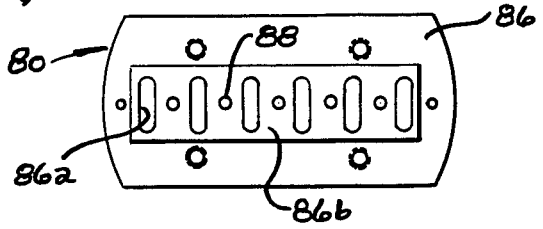
FIG. 9 is an end view of the upper press tool assembly taken on the plane 9—9 of FIG. 8.
Figure 10:
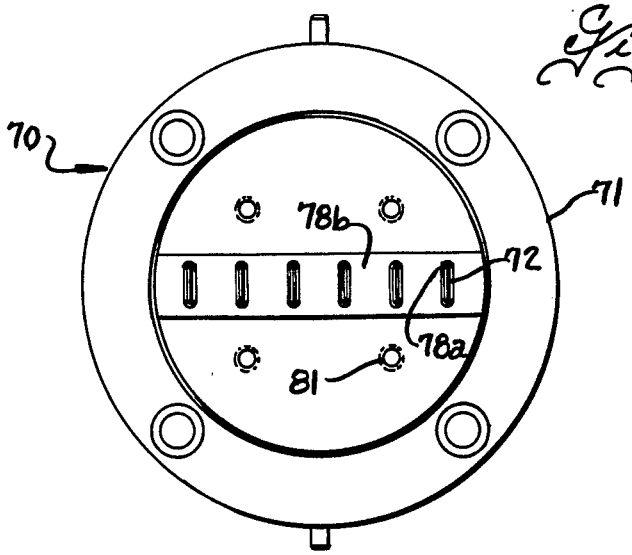
FIG. 10 is a plan view of the lower press tool assembly taken on the plane 10—10 of FIG. 8.

As best shown in FIGS. 7–9, the upper press tool assembly 80 includes upper forming tool means herein shown in the form of an upper die 86 mounted by a die holder 87 on the ram 26 for vertical movement thereby toward and away from the lower press tool assembly. As shown in FIGS. 7–9, the upper die 86 has a plurality of die openings 86*a* therein adapted to register with the lower punches 72, and which have a cross section larger than the cross section of the punches such that the workpiece will be drawn or deformed upwardly as it is pierced by the punches. The upper press tool means includes upper stripper means for stripping the workpiece off the upper forming tool means when the ram means is raised. The upper die 86 has a lower work engaging surface 86*b* and the upper stripper means is herein shown in the form of ejector pins 88 mounted on the upper die 86 for vertical movement relative thereto at locations intermediate the die openings 86*a*, and which ejector pins are yieldably biased downwardly by springs 89 to normally project below the work engaging surface 86*b*, as shown in FIG. 7. The upper stripper springs 89 are selected such that the total downward force exerted on the workpiece W by the ejector pins 88 during a forming operation, is less than the upward force applied to the lower stripper 78 by the lower stripper spring 79.

The punch press ram 26 is operable through a punch cycle from a preset raised position through a downward stroke to a preset lower position and then in an upward return stroke back to the preset raised position. When the ram moves the upper press tool assembly down through a downward stroke, the ejector pins 88 yieldably contact the workpiece at locations intermediate the punches to press the workpiece against the work engaging surface 78*b* on the lower stripper and the work engaging surface 86*b* on the die 86 thereafter engages the upper surface of the workpiece. As the ram continues downward movement, the upper die forces the workpiece downwardly onto the lower forming punch means 72 which pierce the workpiece and form upwardly directed flanges around the pierced openings in the workpiece. The lower stripper springs 79 are adapted to yield and allow the lower stripper plate 78 to move downwardly under the force applied to the upper die by the ram and, when the ram thereafter moves the upper die upwardly in a return stroke, the stripper springs 79 urge the stripper plate 78 upwardly to strip the workpiece off the lower punches.

With the above arrangement, the workpiece must move vertically downwardly during each punching operation and then upwardly during a return stroke of the ram. In accordance with the present invention, a workpiece carrier means 91 is connected to the workpiece carriage means for movement therewith in a horizontal plane along relatively transverse X and Y axes. A workpiece support means 92 is mounted on the carrier means 91 for horizontal movement therewith and for limited movement vertically relative to the carrier means, and operating means are provided for moving the workpiece support means downwardly relative to the carrier means as the workpiece is forced downwardly onto the lower press tool assembly and for moving the workpiece support means upwardly relative to the carrier means as the lower stripper forces the workpiece upwardly off the lower press tool assembly.

Figure 2:
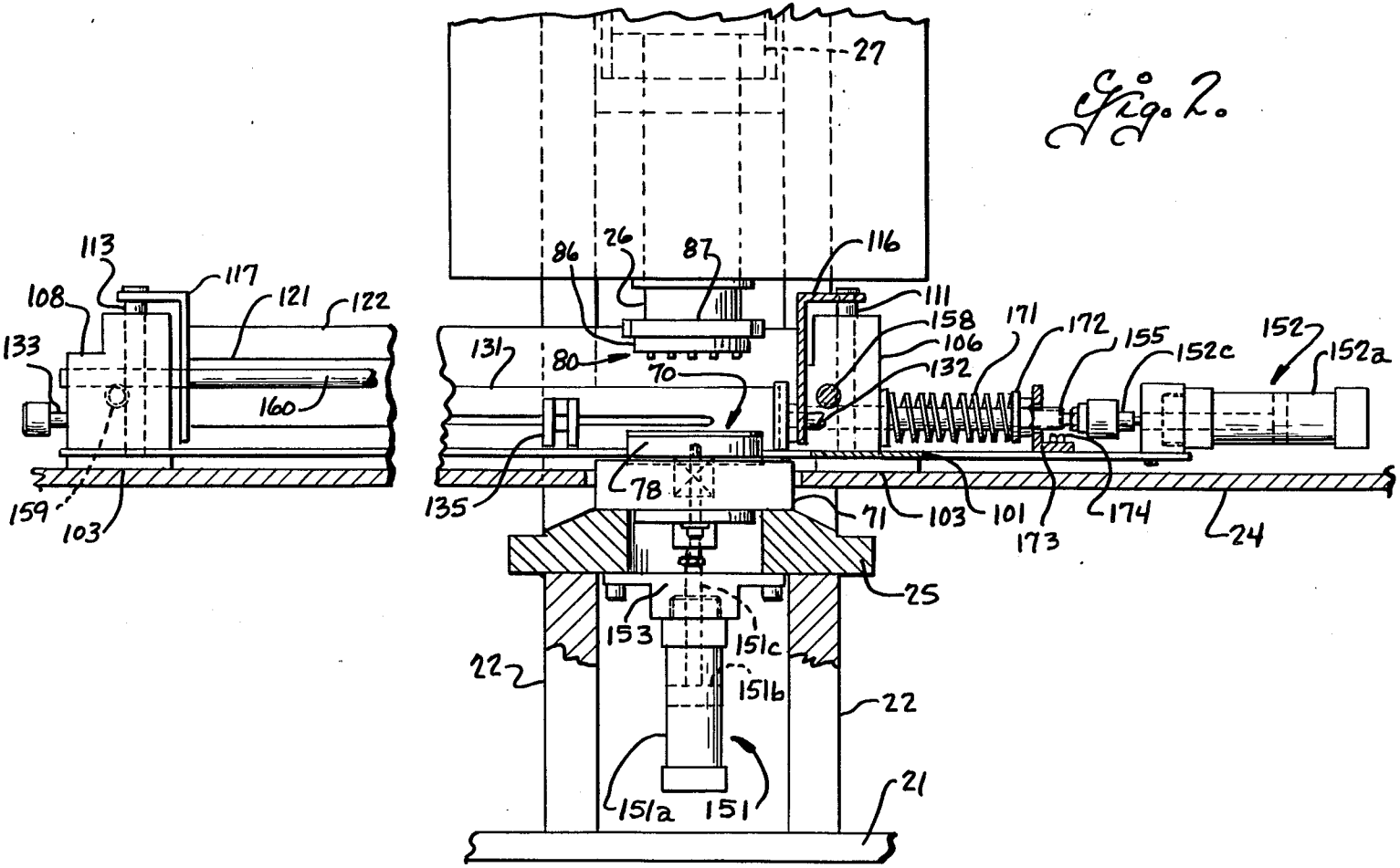
FIG. 2 is a fragmentary vertical sectional view taken on the plane of 2—2 of FIG. 1 and illustrating the parts on a larger scale than FIG. 1.
Figure 3:
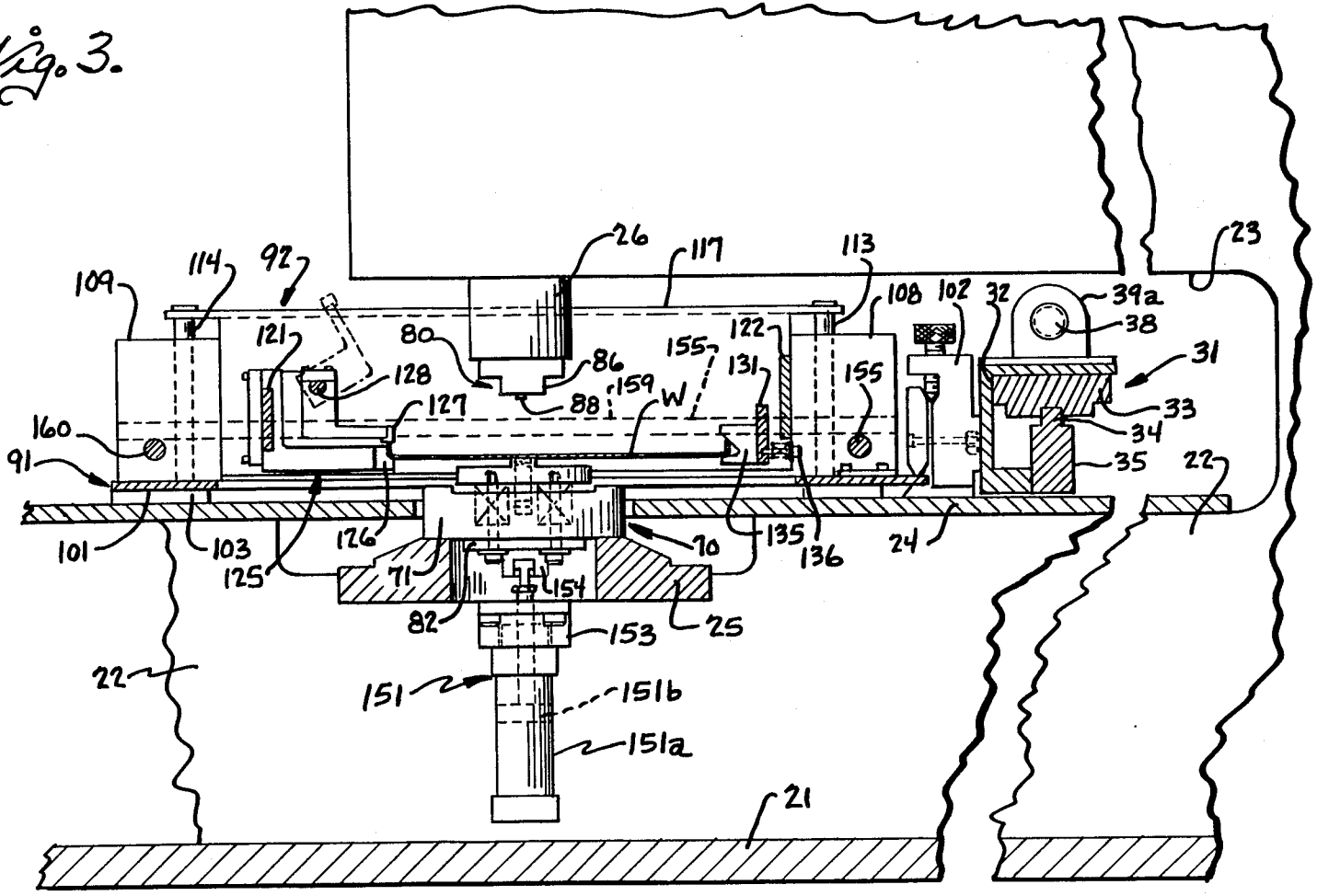
FIG. 3 is a fragmentary vertical sectional view taken on the plane 3—3 of FIG. 1 and illustrating parts on a larger scale than FIG. 1.

The workpiece carrier means includes a frame 101 of generally rectangular configuration as viewed in plan and which defines a central work opening. The frame is attached by any suitable means such as gripper means 102 to the support rail 32 for movement therewith with one end of the frame engaging a locating gauge 104 (FIG. 1) fixed to the support rail. The frame is movable with the rail in a generally horizontal plane along relatively transverse X and Y axes, and the carrier frame 101 is advantageously guidably supported on the work table 24 for movement in a horizontal plane by pads 103 that are fixed to the underside of the carrier frame. The workpiece support means 92 is mounted on the carrier frame for movement horizontally therewith and for limited vertical movement relative thereto. As best shown in FIGS. 1–3, four guide blocks 106–109 are fixed to the carrier frame 101 adjacent the four corners thereof and extend upwardly from the carrier frame. Vertically disposed guide rods 111–114 are guidably mounted as by suitable ball guide bushings 115 (see FIG. 4) in the guide blocks 106–109 respectively for vertical movement relative thereto and means described hereinafter are provided for raising and lowering the guide rods 111–114 in unison.

The workpiece support means are mounted on the guide rods for vertical movement therewith relative to the carrier frame. The workpiece support means 92 includes a first cross member 116 attached to the upper ends of guide rods 111 and 112 and extending therebetween and a second cross member 117 attached to the upper ends of guide rods 113 and 114 and extending therebetween. Forward and rear rails 121 and 122 are attached to the cross members 116 and 117 and extend therebetween. Workpiece clamps 125 are mounted on the forward rail 121 for adjustment therealong and, as best shown in FIG. 3, each clamp includes a lower workpiece support member 126 and a movable clamp 127. The several clamps 127 are slidably and nonrotatably connected to a rod 128 that is rotatably supported in the cross members 116 and 117 and an operating handle 129 (FIG. 1) is provided on one end of the rod 128 to swing the several clamp members in unison into and out of clamping engagement with the workpiece adjacent one edge thereof. An adjustable rail 131 is mounted in guide slots 132 (see FIG. 5) in the cross members 111 and 117 for adjustment toward and away from the work clamps 125 on the rail 121 and the rail 131 is adapted to be locked into adjusted position as by clamp screws 133.

Work support blocks 135 are guidably mounted on the adjustable rail 131 and adapted to be locked in adjusted position therealong as by fasteners 136 (FIG. 3), to accommodate workpieces of different length. As will be readily apparent, the shape of the work support blocks 135 and the shape or configuration of the workpiece support members 126 and clamps 127 will vary dependent on the shape of the edges of the workpiece. In the embodiment illustrated, the workpieces W are in the form of header plates having upwardly extending flanges along the edges and the workpiece support members 126 and blocks 135 are arranged to engage and support the flanged edges of the workpiece.

Operating means are provided for moving the workpiece support means 92 downwardly relative to the carrier means 91 as the upper press tool means on the ram means forces the workpiece downwardly onto the lower press tool means, and for moving the workpiece support means upwardly relative to the carrier means as the ram means moves upwardly in its return stroke. The operating means includes a master actuator means on the press frame and a slave actuator means on the workpiece carrier and a flexible transmission means interconnecting the master and slave actuator means to effect movement of the slave actuator means correlative with the movement of the master actuator means. The master and slave actuator means are advantageously of the hydraulic type and include a master hydraulic actuator means 151 and a slave hydraulic actuator means 152 connected by a flexible hydraulic conduit 185 of the hydraulic type to the master hydraulic actuator means. In the embodiment of FIGS. 1–11, a master hydraulic actuator means 151 is mounted on the punch press frame and operatively connected to the lower stripper for actuation thereby, and a slave hydraulic actuator means 152 is mounted on the carrier frame 101 and operatively connected to the rods 111–114 to raise and lower the workpiece support means. The master hydraulic actuator means 151 includes a fluid cylinder **151*a* having a piston 151*b* slidable therein and a rod 151*c* extending upwardly through the upper end of the cylinder. The upper end of the cylinder is mounted by a bracket 153 on the bolster 25 and the upper end of the rod 151*c* is connected by a bracket 154 to the actuating plate 82 on the stripper 78 for vertical movement with the stripper. The slave hydraulic actuator 152 includes a cylinder 152*a* and a piston 152*b* slidable in the cylinder and a piston rod 152*c* extending out of one end of the cylinder. As described more fully hereinafter, the master hydraulic actuator 151 is hydrostatically connected to the slave hydraulic actuator 152**, to effect movement of the slave piston in response to movement of the master piston.

The slave hydraulic actuator is operatively connected to the vertical guide rods 111–114 to raise and lower the same in response to movement of the piston in the slave hydraulic actuator. The slave hydraulic actuator is mounted on the carrier frame 101 with the piston rod **152*c* disposed generally horizontally and is connected to a longitudinal actuator rod means 155 that is slidably supported in guide blocks 106 and 108. A first pinion rod 158 having pinion gears adjacent opposite ends is rotatably supported in guide blocks 106 and 107 and extends therebetween and a second pinion rod 159 having pinion gears adjacent opposite ends is rotatably supported in guide blocks 108 and 109 and extends therebetween. A rod 160 is slidably supported in guide blocks 107 and 109 and extends therebetween parallel to the actuator rod 155**.

As best shown in FIGS. 4 and 6, the actuator rod 155 has rack portions R adjacent opposite ends and located internally of the guide blocks 106 and 108 respectively, and which rack portions mesh with the pinion gears P provided on the ends of the pinion rods 158 and 159 respectively. Vertical guide rods 111 and 112 have rack teeth T provided thereon that mesh with the pinion gears P on opposite ends of the pinion rod 158 and vertical guide rods 113 and 114 have similar rack teeth thereon that mesh with the pinion gears on opposite ends of the pinion rod 159. The rod 160 has rack teeth adjacent opposite ends that mesh with the pinion gears at the ends of pinion rods 158 and 159 remote from the actuator rod 155, to aid in synchronizing rotary movement of the pinion rods.

The actuator rod 155 is yieldably urged in a direction to raise the workpiece support means 92, that is to the right as viewed in FIGS. 1 and 4, by a spring 171 interposed between the guide block 106 and an abutment 172 on the actuator rod. Provision is made for adjusting the upper position of the workpiece support means. As best shown in FIGS. 2, 4 and 6, a stop 173 is mounted as by bolts 174 for adjustment on the workpiece carrier means 91 and is arranged to engage an abutment such as the abutment 172 on the rod 155 to adjustably stop movement of the rod by spring 171, and thereby adjust the upper position of the workpiece support means and the workpiece supported thereby, relative to the workpiece carrier. The rack teeth on rods 155 and 160 and pinion gears on pinion rods 158 and 159 are arranged so that, when the actuator rod 155 is moved to the right as viewed in FIGS. 1 and 4, herein sometimes referred to as a retracted position, the guide rods 111–114 are moved to a preselected raised position. Abutment 172 on the actuator rod 155 can be adjusted along the rod to adjust the spring force that biases the guide rods 111–114 to their raised position. When the slave cylinder 152 is actuated to move the actuating rod 155 to the left as viewed in FIGS. 1 and 4, the rack and pinion gears are arranged to move the guide rods 111–114 downwardly. The master and slave cylinders preferably have the same diameter or size so that the slave piston will move horizontally a distance substantially equal to the distance that the master piston moves vertically, and the rack and pinion means are arranged so that the work support means is moved vertically a distance equal to the horizontal movement of the slave hydraulic actuator, and hence equal to the movement of the piston rod **151*c*** of the master hydraulic actuator.

In the embodiment of FIGS. 1–11 in which the upper and lower press tools deform areas of the workpiece only upwardly, the underside of the workpiece remains generally planar. Accordingly, the raised position of vertically movable work support means 92 is advantageously adjusted to support the workpiece with the underside of the workpiece closely adjacent the level of the work engaging surface on the lower stripper when the workpiece support means is in its raised position as shown in FIGS. 3 and 7. When the ram moves the die 86 downwardly and forces the workpiece downwardly over the punch means, the lower stripper 78 is depressed and this forces hydraulic fluid from the master hydraulic actuator 151 to the slave hydraulic actuator 152 and the slave hydraulic actuator operates the vertically movable work support means to move the workpiece support means downwardly relative to the carrier, substantially in unison with the downward movement of the stripper. Conversely, when the ram is retracted and raises the die, the stripper moves upwardly and the spring 171, acting under the control of the slave hydraulic actuator, moves the workpiece support means upwardly substantially in unison with the upward movement of the stripper.

Figure 11:
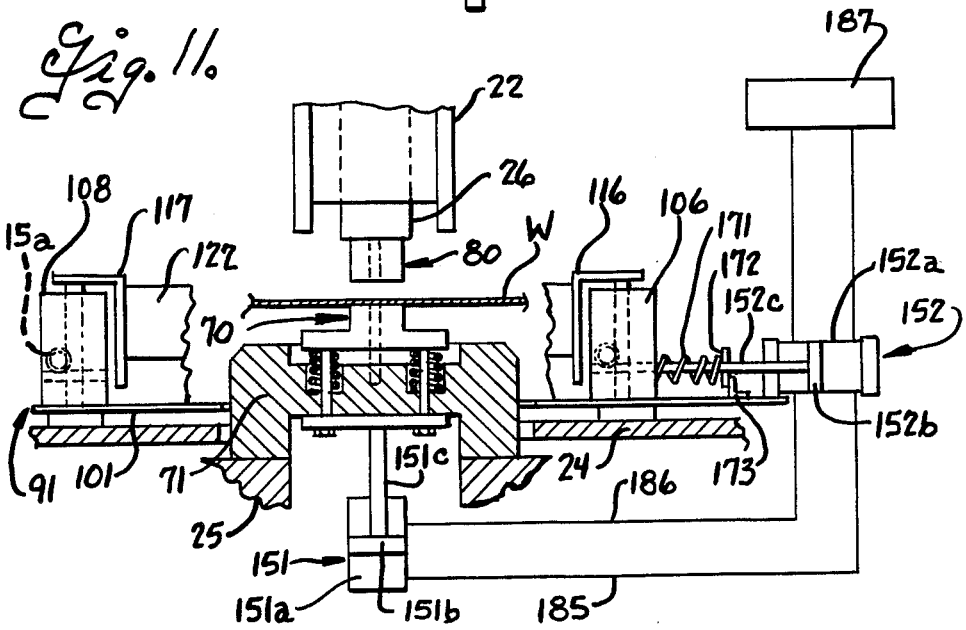
FIG. 11 is a schematic diagram of a hydraulic circuit for vertically moving the work support means on the carrier in response to movement of the lower stripper.

A circuit for hydraulically interconnecting the master and slave hydraulic actuators for actuation in unison is schematically shown in FIG. 11. As shown, at least one end, preferably the blind end of the master hydraulic actuator is connected by conduit 185 to the corresponding blind end of the slave hydraulic actuator 152. The other ends of the master and slave hydraulic actuators may either be separately vented or interconnected by a conduit 186. While the hydraulic actuators 151 and 152 are herein shown in the form of cylinder and piston type actuators, it is deemed apparent that the hydraulic actuators could alternatively be of the diaphragm or bellows type. Any suitable arrangement or system, diagrammatically shown at 187, may be provided for filling the hydraulic circuit including the blind ends of the master and slave actuators and the connecting conduit 185 when the piston in the master actuator is in the raised position determined by the upper position of the stripper 78 and the piston in the slave actuator is retracted against the stop 173. The system 187 may also be arranged to compensate for leakage from the hydraulic circuit and control venting.

From the foregoing it is felt that the construction and operation of the embodiment of FIGS. 1–11 of the punch press will be readily understood. The forming and piercing punches 72 are fixedly supported on the bolster below the workpiece and the die 86 is mounted on the vertically movable ram and so arranged that, when the die is moved downwardly by the ram, the workpiece is forced downwardly over the punch means and the punch means deforms the workpiece upwardly to form a flanged opening in the workpiece as shown in FIG. 8. The stripper 78 is yieldably biased to a raised position with its work engaging surface adjacent the level of the top of the punches to strip the workpiece off the punch when the ram is retracted. The work support carrier 91 means including frame 101 is connected to the work positioning carriage means for movement thereby in a horizontal plane along relatively transverse X and Y axes to position different areas of the workpiece at the punch press work station. The workpiece support means 92 is movable vertically relative to the carrier frame 101 and, in its raised position, supports the workpiece W with the lower side of the workpiece at a level adjacent the work engaging surface of the lower stripper. The master hydraulic cylinder 151 is operatively connected to the lower stripper 78 for actuation thereby and the slave hydraulic actuator means 152 is operatively connected to the vertically movable workpiece support means to raise and lower the workpiece support means and the workpiece carried thereby substantially in unison with the vertical movement of the lower stripper. Thus, when the lower stripper is moved downwardly in response to downward movement of the die, the workpiece support means moves the workpiece downwardly and, conversely, when the punch is retracted and the stripper moves the workpiece upwardly to strip the workpiece from the die, the workpiece support means moves upwardly to support the workpiece at a level adjacent the work engaging surface of the stripper. The work positioning carriage can then move the workpiece carrier horizontally along either X or Y axis or both to position a different area of the workpiece at the punch press work station for a succeeding punching and forming operation.

Figure 12:
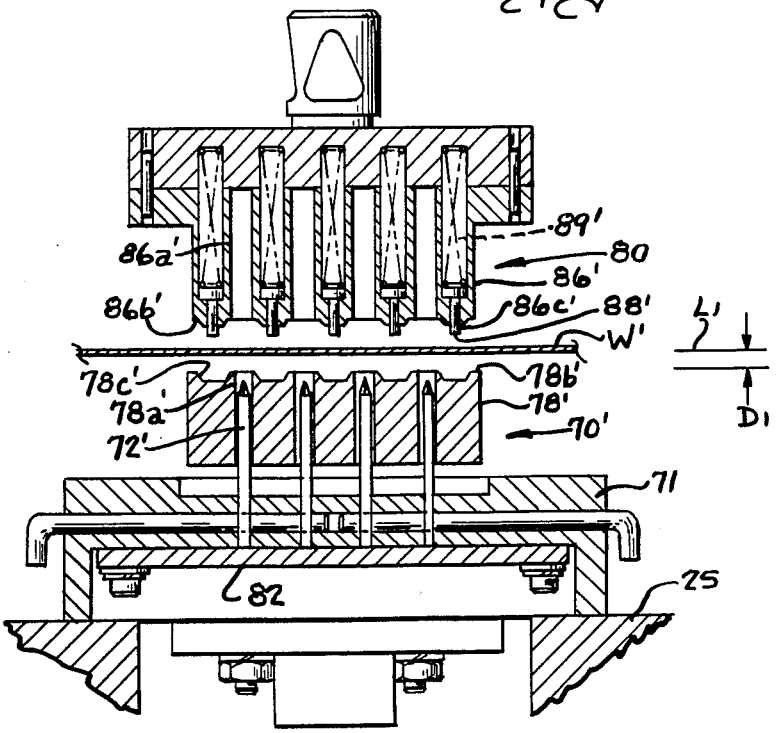
FIGS. 12 and 13 are vertical sectional views through a modified upper and lower press tool means for deforming areas of the workpiece in relatively opposite directions, and illustrating the upper and lower press tool means in different moved positions.
Figure 13:
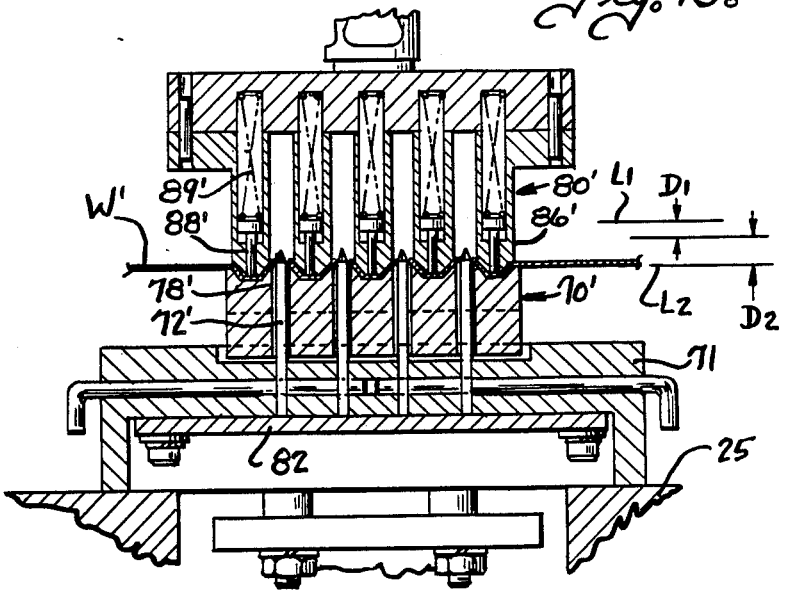

It is sometimes desired to perform successive forming operations on different areas of the workpiece in which the workpiece is deformed only downwardly or both downwardly and upwardly from the plane of the workpiece. When areas of the workpiece are deformed downwardly from the normal plane of the workpiece, the lower side of the workpiece cannot rest upon or be guided on the upper work engaging surface of the lower stripper during horizontal movement of the workpiece, as disclosed in the embodiments of FIGS. 1–11. FIGS. 12 and 13 illustrate upper and lower press tool means which are adapted to deform some areas of the workpiece laterally upwardly and other areas of the workpiece laterally downwardly from the normal plane of the workpiece, during a forming operation. The upper and lower press tools illustrated in FIGS. 12 and 13 are similar to those illustrated in the embodiment of FIGS. 1–8, and the same numerals are used to designate corresponding parts with like numerals followed by the postscript ′, used to designate modified parts.

In the press tool assembly shown in FIGS. 12 and 13, the lower press tool means 70′ includes a lower press tool holder 71′ mounted on the bolster 25, and lower forming tool means in the form of a plurality of forming and piercing punches 72′ that are mounted on the lower press tool holder and extend upwardly therefrom. The lower press tool means also includes a lower stripper 78′ having punch receiving openings **78*a*′ therethrough. As described in connection with the embodiment of FIGS. 1–11, the stripper is guided by guide pins on the lower press tool holder and yieldably biased upwardly by springs to position the upper work engaging surface 78*b*′ at a level at or above the upper ends of the punches 72′. An actuating plate 82 is fixed to the lower ends of the pins 81 for vertical movement with the stripper plate, and is adapted to engage the underside of the lower press tool holder 71′** when the stripper is in its fully raised position.

The upper press tool assembly 80′ includes an upper forming tool herein shown in the form of an upper die 86′ attached to a die holder 87. The upper die 86′ has a plurality of die openings **86*a*′ adapted to register with the lower punches and having a cross section somewhat larger than the punches and such that the lower punches are adapted to pierce openings in the workpiece W′ and draw the workpiece upwardly around the pierced opening to form upwardly extending flanges around the openings. In the die assembly shown in FIGS. 12 and 13, the lower work engaging surface 86*b*′ on the upper die is formed with embossing ribs 86*c*′ at locations intermediate the die openings 86*a*′, and the stripper 78′ on the lower press tool assembly 70′ is provided with recesses 78*c*′ located to register with the embossing ribs 86*c*′ on the upper die assembly. With this arrangement, the upper die assembly is adapted to deform the workpiece downwardly in areas intermediate the upwardly flanged openings formed in the workpiece by the punches 72′. As in the preceding embodiment, the upper press tool assembly also includes upper stripper means, herein shown in the form of a plurality of ejector pins 88′ guidably mounted in the upper die 86′ and yieldably biased downwardly by springs 89′. The ejector pins are arranged to normally project below the ribs 86*c*′ on the upper die 86′, as shown in FIG. 12**.

In the die assembly of FIGS. 12 and 13, the workpiece W' is deformed upwardly in areas engaged by the lower punches 72' and downwardly in areas engaged by the ribs 86c' on the upper die assembly, when the ram moves the upper press tool assembly down to the lower position shown in FIG. 13. When the ram is retracted to its raised position, the lower stripper presses the workpiece upwardly off of the lower punches 72' and the upper ejector pins press the workpiece off the upper die 86'. However, since the upper and lower die assemblies deform the areas of the workpiece downwardly from its normal plane, it is also necessary to raise the workpiece to a level above the lower die assembly, in order to allow the workpiece to be moved horizontally for positioning different areas of the workpiece at the work station. FIG. 14 schematically illustrates a modified hydraulic circuit for vertically moving the work support means relative to the carrier. The hydraulic circuit of FIG. 14 is a modification of the circuit of FIG. 11 and like numerals are used to designate the same parts and like numerals followed by the postscript ' used to designate modified or added parts. In this embodiment, master hydraulic actuator 151 is connected to the lower stripper 70' for actuation in response to vertical movement of the lower stripper, and the master hydraulic actuator is hydrostatically connected through line 185 to a slave hydraulic actuator 152 mounted on the work positioning carrier 91. The master and slave hydraulic actuators 151 and 152 are arranged to move the workpiece support means 92 vertically relative to the workpiece carrier, a distance correlative with the vertical movement of the lower stripper means 70'. In this embodiment, provision is also made for operating the workpiece support means 92 to raise the workpiece W' to a position spaced above the lower press tool assembly 70', at the completion of each forming operation, and to thereafter move the workpiece support means downwardly a distance to bring the workpiece W' substantially into contact with the work engaging surface of the lower press tool means, before the upper press tool means forces the workpiece downwardly. As diagrammatically shown in FIG. 14, a master cylinder 201' is fixedly mounted as by a bracket 202' on one of the press frame members 22. The master hydraulic actuator 201' includes a cylinder 201a', having a piston 201b' slidable therein and a rod 201c' extending from one end of the cylinder. The piston 201b' of the master cylinder 201' is arranged to be operated through a preselected stroke in response to downward movement of the ram 26. For this purpose, the rod 201c' is connected to a plunger 203' that is slidably supported as in a bushing 204' on the bracket 202'. The plunger 203' is yieldably biased in a direction toward the ram 26 by a spring 205', and the plunger has a cam follower such as a roller 206' at its end arranged to engage a cam 207' on the ram. The cam 207' is mounted on the ram 26 for movement therewith and may, for example, comprise a stepped cam having an outer dwell portion 207a', an inclined cam portion 207b' and an inner dwell portion 207c'. A slave hydraulic actuator 211' is interposed between the piston rod 152c of the slave actuator 152 and the actuator rod 155 for the workpiece support means 92. As diagrammatically shown, the slave hydraulic actuator 211' includes a cylinder 211a' that is connected to the actuator rod means 155 for movement therewith, and a piston 211b' that has a rod 211c' connected to the rod 152c of the hydraulic actuator 152, so that the pistons 211b' and 152b move substantially in unison. A means such as a bushing 213' can be provided for guidably supporting the end of the rod 211c' or the cylinder 211a' or both, to allow axial movement of the actuator 211a' relative to the work carrier 91. A spring 171a' interposed between a fixed abutment such as the guide block 108 and the cylinder 211', to yieldably bias the cylinder and the actuator rod means 155 in a direction (to the right as viewed in FIG. 14) to engage an adjustable stop 173a' on the carrier frame 101. Another spring 173b' is interposed between a fixed abutment such as the bushing 213' and an abutment 172' on the rod 152c, to yieldably urge the rod 152c and piston 152b to the right as viewed in FIG. 14, into engagement with an adjustable stop 173b' on the workpiece carrier 101.

Stop 173b' sets the retracted position of the piston 152b and hence the retracted position of the piston 211b' in the actuator 211'. Stop 173a' is adjusted, when the ram 26 is in its raised position and the lower stripper 78' is in its raised position as shown in FIG. 14, to position the workpiece support means 92 in a raised position in which it supports the workpiece W' at a level designated $L_1$ in FIGS. 12 and 13, with its underside spaced above the lower press tool means 70', a preselected distance designated $D_1$. The upper level $L_1$ is selected such that those areas of the workpiece that are formed or depressed downwardly from the plane of the workpiece during a forming operation, will be at level above the upper work engaging surface on the lower press tool means to allow the workpiece to be moved horizontally after each forming operation.

As previously described, the actuating rod means 155 for the work support means is arranged to move the work support means downwardly when the rod 155 is moved in one direction, that is to the left as viewed in FIG. 14, and to raise the work support means relative to the work carrier when the rod 155 is moved in the other direction, that is to the right as viewed in FIG. 14. Spring 171a' normally biases the cylinder 211a' against stop 173a', to normally raise the workpiece support means to its raised position supporting the workpiece at the level $L_1$. The master actuator 201' is hydrostatically connected through line 215 to the slave actuator 211' to lower the work support means the preselected distance $D_1$ as the ram is moved downwardly and before the upper forming tool means 80' contacts the workpiece. As shown in FIG. 14, the piston 201b' in the master hydraulic actuator 201' is aranged to be moved by the cam 207' to the right as viewed in FIG. 14, when the ram is moved downwardly from the raised position shown in that figure. Actuator 201' is connected by hydraulic conduit 215' to actuator 211', in a manner to move the cylinder 211a' to the left relative to the piston 211b', when piston 201b' is moved to the right. Thus, when the ram is moved from its raised position in a downward stroke, the cam 207' first operates the master hydraulic actuator 201' to move the cylinder 211a' of the slave hydraulic actuator 211 to the left a preselected distance to lower the workpiece support means a distance corresponding to D1 in FIG. 12, to a position in which the lower side of the workpiece is at or closely adjacent to the upper work engaging surface on the lower press tool assembly. As the ram continues downward movement, the upper press tool means engages the workpiece and moves the lower stripper 78' downwardly. During that portion of the ram cycle, the master hydraulic actuator 151 and slave actuator 152 operate the work support means 92 to lower the workpiece a further distance designated $D_2$ in FIG. 13 to a preselected lower level $L_2$, substantially in unison with the movement of the stripper 78', in a manner previously described in connection with FIGS. 1–11. Any suitable means (not shown) may be provided to compensate for leakage from the actuators 201' and 211'.

A second modified hydraulic circuit for raising and lowering the work support means 92 relative to the work positioning carrier 91, is illustrated in FIG. 15. The circuit shown in FIG. 15 is arranged for operation with upper and lower press die means that deform the workpiece both upwardly and downwardly, for example as shown at 80' and 70' in FIGS. 12 and 13. The hydraulic circuit of FIG. 15 is generally similar to that shown in FIG. 11 and like numerals are used to designate the same parts with like numerals followed by the postscript " to designate modified parts. In this embodiment, the slave hydraulic actuator 152 is mounted on the workpiece carrier 91 in the manner previously described in connection with FIGS. 1–11 and the piston **152*b* is yieldably urged by spring 171 to a retracted position against the stop 173. In this embodiment, the master hydraulic actuator 151" is arranged for actuation directly by the ram 26, instead of by the stripper on the lower press tool assembly. Actuator 151" includes a cylinder 150*a*" mounted as by a bracket 202" on a press frame member 22. Actuator 151" has a piston 151*b*" slidable in the cylinder and a rod 151*c*" extending out of the cylinder and connected to a plunger 203" having a cam follower 206" at one end. The plunger is guided as by a bushing 204" mounted on the bracket 202" and the plunger is yieldably urged to an extended position by a spring 205"**.

A cam 207" is mounted on the ram 26 for movement therewith and includes an inner dwell portion **207*a*", a first cam portion 207*b*", an intermediate dwell portion 207*c*", a second cam portion 207*d*", and an outer dwell portion 207*e*". The master hydraulic actuator 151" is connected through line 185 to the slave hydraulic actuator 152 and is constructed and arranged with respect to the cam 207' to move the workpiece support means 92 to a raised position in which the workpiece W' is positioned at a level designated $L_1$ in FIGS. 12 and 13 spaced a selected distance such as indicated at $D_1$ above the lower press tool means 70', when the ram is in a raised position as shown in FIG. 15, with the follower 206" engaging the inner dwell portion 207*a*" of the cam 207". As the ram moves downwardly in a forming stroke the first cam portion 207*b*" cams the plunger to the right until it rides on the intermediate dwell portion 207*c*". The first cam portion 207*b*" is arranged to move the piston 151*b*" of the master cylinder 151" in a direction and through a distance such that the slave hydraulic actuator 152 moves the work support means 92 downwardly from the level $L_1$ a distance $D_1$ sufficient to bring the lower side of the workpiece W' into close proximity with the upper work engaging surface 70*b*' on the lower press tool assembly. The cam 207" is adjusted relative to the ram such that the second cam surface 207*d*" will engage the follower 206" when the forming die of the upper press tool means initially contacts the upper surface of the workpiece W' during the downward stroke of the ram, and the cam surface 207*c*' is shaped so as to actuate the master hydraulic actuator 151" in a direction and through a distance such that the slave hydraulic actuator 152 moves the work support means 92 and workpiece W' downwardly substantially in unison with the downward movement of the lower stripper 78'. When the ram is thereafter moved upwardly at its return stroke, the cam follower 206" moves to the left under the bias of spring 205' and the master hydraulic acutator 151" operates the slave hydraulic actuator 152 to raise the workpiece support means 92 substantially in unison with upward movement of the stripper. As the ram continues its upward movement, the upper press tool means moves away from the upper surface of the workpiece and, when the cam follower 206' rides outwardly on the first cam surface 207*b*', the master hydraulic actuator 151" operates the slave hydraulic actuator 152 to move the workpiece support means 92** upwardly a further distance $D_1$ to raise the workpiece W' to the level $L_1$ spaced above the upper surface of the lower press tool means a distance $D_1$ sufficient to allow horizontal movement of the workpiece.

In the embodiment of FIG. 15, the workpiece support means 92 is adjusted so that, in its fully raised position, it supports the workpiece W' at a level spaced above the lower press tool means to allow a workpiece with downwardly deformed portions to be moved horizontally relative to the press tool means when the ram is in a raised position. The cam 207" is arranged to operate the master hydraulic actuator in two steps, to first move the workpiece support means 92 downwardly until the workpiece is adjacent the lower press tool means, and to thereafter move the workpiece support means downwardly in substantially in unison with the lower stripper. As is deemed apparent, if the workpiece is only deformed upwardly as disclosed in FIGS. 1–11, then the workpiece support means can be adjusted so as to normally support the workpiece at the level of the lower press tool means and the cam 207" arranged so that it only operates the master hydraulic actuator in a single step, to move the support means downwardly and upwardly substantially in unison with the lower stripper means. For example, the cam 207" can be modified by an insert **207*x* shown in phantom lines in FIG. 16, to eliminate the effect of the main dwell portion 207*a*" and the first cam portion 207*b***.

In the embodiments of FIGS. 14 and 15, the hydraulic actuators are diagrammaticly illustrated as of the cylinder and piston type. It is deemed apparent that the hydraulic actuators could also be of the diaphragm or bellows type. Alternatively, a flexible mechanical motion transmitting means such as a flexible Bowden cable could be used to transmit motion of the plunger 203" to the actuator rod means 155, while accommodating horizontal movement of the workpiece carrier means 91.

The embodiments of the invention in which an exclusive property or privilege is claimed are defined as follows:

1. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said means for moving said carrier means in a generally horizontal plane including means for moving the carrier means along a generally horizontal X-axis and means for moving the carrier means along a generally horizontal Y-axis transverse to said X-axis.

2. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said operating means including master actuator means mounted on the stationary frame means and slave actuator means mounted on the carrier means, and motion transmission means connecting the master and slave actuator means.

3. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said operating means including master hydraulic actuator means mounted on the stationary frame means and actuated in a first direction during downward movement of said ram means and actuated in a second direction during upward movement of said ram means, slave hydraulic actuator means mounted on the carrier means and operatively connected to the workpiece support means for moving the latter vertically relative to the carrier means, and means hydrostatically connecting the master and slave hydraulic actuator means.

4. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said operating means including a master hydraulic actuator means mounted on the stationary frame means, means including an operator movable with the ram means for actuating the master hydraulic actuator means in a first direction during a portion of the downward stroke of the ram means and for actuating the master hydraulic actuator means in the opposite direction during the upward return stroke of the ram means, slave hydraulic actuator means mounted on the carrier means and operatively connected to the workpiece support means for moving the latter vertically relative to the carrier means, and means hydrostatically connecting the master and slave hydraulic actuator means.

5. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, the workpiece support means being operative in a preselected raised position relative to the carrier means to support the workpiece with its lower side at a level spaced above the lower press tool means, said operating means including means operable during a first portion of the downward stroke of the ram means for moving the workpiece support means downward to an intermediate position in which the lower side of the workpiece is closely adjacent the lower press tool means, said operating means including means for moving the workpiece support means downwardly from said intermediate position substantially in unison with the downward movement of the workpiece by the upper press tool means.

6. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said lower press tool means including lower forming tool means and lower stripper means mounted for limited vertical movement relative to the lower press tool means and having an upper work engaging surface, said workpiece support means being operative in a preselected raised position to support the workpiece with its lower side adjacent the work engaging surface on the lower stripper means, said operating means including a master hydraulic actuator mounted on the stationary frame means and actuated by said lower stripper means, slave hydraulic actuator means mounted on the carrier means and operatively connected to the workpiece support means for moving the latter vertically relative to the carrier means, and means hydrostatically connecting the master and slave hydraulic actuator means.

7. A press according to claim 6 wherein said means for moving said carrier means in a generally horizontal plane includes means for moving the carrier means along a generally horizontal X-axis and means for moving the carrier means along a generally horizontal Y-axis transverse to said X-axis.

8. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said press including a generally horizontal table, said carrier means being guidably supported on said table for movement in said generally horizontal plane, said means for moving said carrier means including means for moving the carrier means along a generally horizontal X-axis and means for moving said carrier means along a generally horizontal Y-axis transverse to said X-axis.

9. A press for performing successive forming operations on different areas of a workpiece having upper and lower sides, the press including stationary frame means having a work station, lower press tool means mounted on the stationary frame means below the work station, ram means mounted on the frame means above the work station and operable through a cycle having a downward punch stroke and an upward return stroke, upper press tool means mounted on the ram means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward stroke to press the workpiece downwardly, and operating means for moving the workpiece support means downwardly relative to the carrier means during movement of the ram means in said downward stroke and for moving the workpiece support means upwardly relative to the carrier means during movement of the ram means in said upward return stroke, said press having a generally horizontal table, said carrier means including a generally rectangular frame guidably supported on said table for movement in a generally horizontal plane, first and second pairs of vertical rack members mounted on said frame for vertical movement relative thereto, first and second generally horizontal pinion means interconnecting the first pair of vertical rack members and the second pair of vertical rack members respectively, a generally horizontal actuating rack means engaging the first and second pinion means for moving the same in a direction to raise the first and second pairs of vertical rack members when the actuating rack means is moved in a first direction and to lower the first and second pairs of vertical rack members when actuating rack means is moved in a second direction, means yieldably urging the actuating rack means in said first direction, and means mounted on the carrier frame and connected to said actuating rack means for moving the actuating rack means in said second direction.

10. A press according to claim 9 wherein said operating means includes a master hydraulic actuator means mounted on said stationary frame means and actuated in a first direction during downward movement of said ram means and actuated in a second directin during upward movement of the ram means and a slave hydraulic actuator connected by a flexible conduit to the master hydraulic actuator.

11. A press according to claim 9 wherein said workpiece support means includes a first set of clamp means for engaging a workpiece adjacent one edge and a second set of clamp means for engaging a workpiece adjacent a second edge, and means mounting the first and second sets of clamp means for adjustment toward and away from each other to accommodate workpieces of different size.

12. A press for performing successive punching operations on different areas of a workpiece having upper and lower sides, the press including stationary frame means having a work station, lower press tool means mounted on the stationary frame means below the work station, the lower press tool means including lower forming tool means and lower stripper means mounted for limited vertical movement relative to the lower forming tool means, ram means mounted on the frame means above the work station and operable through a cycle having a downward stroke and an upward return stroke, upper press tool means mounted on the ram means, and including upper forming tool means and upper stripper means mounted for limited vertical movement relative to the upper forming tool means, means for moving the lower stripper means to a raised position when the ram means is moved in said upward return stroke for stripping the workpiece off the lower forming tool means, workpiece carrier means mounted for movement in a generally horizontal plane relative to the stationary frame means, workpiece support means mounted on the carrier means for movement horizontally therewith and for limited vertical movement relative thereto, means for moving the carrier means in said generally horizontal plane to position different areas of the workpiece at the work station, the upper press tool means being operative when the ram means is moved in said downward punch stroke to press the workpiece downwardly onto the lower press tool means, the lower stripper means being operative during said upward return stroke to force the workpiece upwardly off the lower forming tool means, and operating means for moving the workpiece support means downwardly relative to the carrier means as upper press tool means on the ram means forces the workpiece and lower stripper means downwardly relative to the lower forming tool means and for moving the workpiece support means upwardly relative to the carrier means as the lower stripper means forces the workpiece upwardly off the lower forming tool means.

13. A press according to claim 12 wherein said operating means includes master hydraulic actuator means mounted on the stationary frame means and operatively connected to the lower stripper means for actuation thereby, slave hydraulic actuator means mounted on the carrier means and operatively connected to the workpiece support means for moving the same, and conduit means connecting the master hydraulic actuator means to the slave hydraulic actuator means.

14. A press according to claim 12 wherein said carrier means includes a generally horizontal carrier frame, a plurality of members guidably mounted on the carrier frame for vertical movement relative thereto at spaced locations on the carrier frame and connected to the workpiece support means, said operating means including a first hydraulic actuator means mounted on the carrier frame for movement therewith and having a movable first operating rod, means including rack and pinion means operatively connecting said first operating rod to said members for moving the members vertically in response to movement of the first operating rod, a second hydraulic actuator means mounted on the stationary frame means and having a second operating rod operatively connected to said stripper means, and conduit means connecting the first and second hydraulic actuator means.

15. A press according to claim 12 wherein said workpiece support means is operative in a preselected upper position thereof to support the workpiece with its lower side spaced above the lower stripper means, said operating means including means operative during a portion of the downward stroke of the ram means to move the workpiece support means downwardly from said preselected upper position to an intermediate position in which the underside of the workpiece engages the lower stripper means and to thereafter move the workpiece support means downwardly from the intermediate position to a preselected lower position as the upper press tool means forces the workpiece and lower stripper means downwardly.

16. A punch press according to claim 12 wherein said operating means includes a master hydraulic actuator means mounted on the stationary frame means, means including an operator movable with the ram means for actuating the master hydraulic actuator means in a first direction from a first position to a second position during a portion of the downward stroke of the ram means and for actuating the master hydraulic actuator means in the opposite direction back to its first position during a portion of upward stroke of the ram means, slave hydraulic actuator means mounted on the carrier means and operatively connected to the workpiece support means for moving the latter vertically relative to the carrier means, and conduit means connecting the master and slave hydraulic actuator means.

17. A press according to claim 12 wherein the operating means includes a first hydraulic actuator means mounted on the stationary frame means and operatively connected to the lower stripper means for actuation thereby, a second hydraulic actuator means mounted on the carrier means and hydraulically connected to the first hydraulic actuator means, means operatively connecting the second hydraulic actuator means to the workpiece support means for moving the support means from said intermediate to said preselected lower position, a third hydraulic actuator means mounted on the stationary frame means, means responsive to movement of the ram means for actuating the third actuator means, a fourth hydraulic actuator means hydraulically connected to said third hydraulic actuator means, and means operatively connecting said fourth hydraulic actuator means to the workpiece support means for moving the workpiece support means between said preselected upper position and said intermediate position.

18. A press for performing successive forming operations on different areas of a workpiece having upper and lower sides, the press including stationary frame means having a work station, lower press tool means mounted on the frame means at the work station and including lower forming tool means and lower stripper means mounted for limited movement relative to the lower forming tool means and having an upper work engaging surface, ram means mounted on the frame means above the work station and operable through a cycle having a downward stroke and an upward return stroke, upper press tool means mounted on the ram means and including upper forming tool means and upper stripper means mounted for limited vertical movement relative to the upper forming tool means, means yieldably urging the lower stripper means upwardly to a preselected raised position in which the upper work engaging surface is above the lower forming tool means, carrier means mounted on the frame means for movement in a generally horizontal plane, workpiece support means mounted on the carrier means for limited vertical movement relative thereto, said workpiece support means being operative in a preselected position thereof to support a workpiece with the lower side of the workpiece adjacent the workpiece engaging surface on the lower stripper means, the upper press tool means being operative during the downward stroke of the ram means to engage the workpiece and press the workpiece downwardly onto the lower press tool means, the lower stripper means being adapted to move downwardly from the preselected raised position thereof in response to downward forces applied to the workpiece by upper press tool means on the ram means, means for moving the carrier means in said generally horizontal plane relative to the stationary frame means to position different areas of the workpiece at the work station, and operating means operative when the upper press tool means on the ram means moves the lower stripper means downwardly from the preselected raised position thereof for moving the workpiece support means downwardly from said preselected position thereof through a distance correlative with the downward movement of the lower stripper means.

19. A press according to claim 18 wherein said means for moving said carrier means in a generally horizontal plane includes means for moving the carrier means along a generally horizontal X-axis and means for moving the carrier means along a Y-axis transverse to said X-axis.

20. A press according to claim 18 wherein said press includes a generally horizontal table, said carrier means being guidably supported on said table for movement in said generally horizontal plane, said means for moving said carrier means including means for moving the carrier means along a generally horizontal X-axis and means for moving said carrier means along a generally horizontal Y-axis transverse to said X-axis.

21. A press according to claim 18 including means responsive to movement of said ram means for moving said workpiece support means above said preselected position to raise the workpiece to a level above the lower stripper means when the ram means is moved in said return stroke.

22. A press for performing succesive forming operations on different areas of a workpiece having upper and lower sides, the press including stationary frame means having a work station, lower press tool means mounted on the frame means at the work station and including lower forming tool means and lower stripper means mounted for limited movement relative to the lower forming tool means and having an upper work engaging surface, ram means mounted on the frame means above the work stations, and operable through a cycle having a downward stroke and an upward return stroke, upper press tool means mounted on the ram means, means yieldably urging the lower stripper means upwardly to a preselected raised position in which the upper work engaging surface is above the lower forming tool means, carrier means mounted on the frame means for movement in a generally horizontal plane, workpiece support means mounted on the carrier means for limited vertical movement relative thereto, said workpiece support means being operative in a preselected position thereof to support a workpiece with the lower side of the workpiece adjacent the workpiece engaging surface on the stripper means, the upper press tool means being operative during the downward stroke to the ram means to engage the workpiece and force the workpiece downwardly onto the lower press tool means, the lower stripper means being adapted to move downwardly from the preselected raised position thereof in response to downward forces applied to the workpiece by the upper press tool means on the ram means, means for moving the carrier means in said generally horizontal plane relative to the stationary frame means to position different areas of the workpiece at the work station, a master hydraulic actuator means mounted on the stationary frame means and having a vertically movable actuator rod operatively connected to said lower stripper means for actuation thereby, a slave hydraulic actuator means mounted on said carrier means and having a horizontally movable actuator rod, means operatively connecting said horizontally movable actuator rod to said workpiece support means for moving the latter vertically in response to horizontal movement of said horizontally movable actuator rod, and conduit means connecting the master and slave hydraulic actuator means.

23. A press according to claim 22 wherein said means operatively connecting said horizontally movable actuator rod to the workpiece support means includes vertically movable rack means mounted on the carrier means and connected to said workpiece support means, horizontally movable rack means connected to said horizontally movable actuator rod, and pinion means rotatably mounted on the carrier means or interconnecting the horizontally and vertically movable rack means.

24. A press according to claim 22 wherein said means for moving said carrier means in a generally horizontal plane includes means for moving the carrier means along a generally horizontal X-axis and means for moving the carrier means along a generally horizontal Y-axis transverse to said X-axis.

25. A press according to claim 22 wherein said press includes a generally horizontal table, said carrier means being guidably supported on said table for movement in said generally horizontal plane, said means for moving said carrier means including means for moving the carrier means along a generally horizontal X-axis and means for moving said carrier means along a generally horizontal Y-axis transverse to said X-axis.

26. A press according to claim 22 wherein said workpiece support means includes a first set of clamp means for engaging a workpiece adjacent one edge and a second set of clamp means for engaging a workpiece adjacent a second edge, and means mounting the first and second sets of clamp means for adjustment toward and away from each other to accommodate workpieces of different size.

* * * * *